US009044850B2

(12) United States Patent
Kokinelis et al.

(10) Patent No.: US 9,044,850 B2
(45) Date of Patent: Jun. 2, 2015

(54) TWIST LOCK GEAR CASE FOR POWER TOOLS

(75) Inventors: Christopher Anthony Kokinelis, Flemington, NJ (US); Justin Terrance Chellew, Lebanon, NJ (US); Timothy John Bok, Bethlehem, PA (US); Daniel Jay Becker, Monroe Township, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 588 days.

(21) Appl. No.: 13/431,281

(22) Filed: Mar. 27, 2012

(65) Prior Publication Data

US 2013/0025900 A1 Jan. 31, 2013

Related U.S. Application Data

(60) Provisional application No. 61/512,183, filed on Jul. 27, 2011.

(51) Int. Cl.
*B25F 5/02* (2006.01)
*B25F 5/00* (2006.01)

(52) U.S. Cl.
CPC ..... *B25F 5/02* (2013.01)

(58) Field of Classification Search
CPC ..... B25F 5/02; B25F 5/00; B25F 5/006
USPC ..... 173/216, 217, 170, 162.2; 310/50; 16/110.1
See application file for complete search history.

(56) References Cited

U.S. PATENT DOCUMENTS

| | | | | |
|---|---|---|---|---|
| 4,697,453 | A | 10/1987 | Murakawa et al. | |
| 5,033,552 | A | 7/1991 | Hu et al. | |
| 5,624,000 | A | 4/1997 | Miller | |
| 6,672,402 | B2 | 1/2004 | Ortt et al. | |
| 2005/0087353 | A1 * | 4/2005 | Oki et al. | 173/162.2 |
| 2006/0201688 | A1 | 9/2006 | Jenner et al. | |
| 2009/0114412 | A1 | 5/2009 | Hatfield | |
| 2010/0252295 | A1 | 10/2010 | Schroeder et al. | |

FOREIGN PATENT DOCUMENTS

| | | | |
|---|---|---|---|
| CN | 201632998 | U | 11/2010 |
| EP | 1 099 517 | A2 | 5/2001 |

(Continued)

OTHER PUBLICATIONS

International Search Report Corresponding to International Application No. PCT/US2011/030646; Date of Mailing: Mar. 28, 2012; 11 Pages.

(Continued)

*Primary Examiner* — Michelle Lopez
(74) *Attorney, Agent, or Firm* — Sunstone IP

(57) ABSTRACT

A power tool includes a motor having an outwardly extending rotor that defines a drive axis, a housing surrounding the motor, and a gearcase that includes a drive train coupled to the rotor and configured to drive a tool output. The gearcase includes a proximal end and an opposite distal end that is exposed to the outside of the tool forward of the housing. The gearcase includes respective locking elements spaced around the periphery of the gearcase proximal end. A motor mount includes spaced apart locking elements that are configured to engage with respective gearcase locking elements. The proximal end portion of the gearcase is adapted to make contact with the motor mount between the locking elements and then rotate such that the gearcase locking elements engage the motor mount locking elements.

20 Claims, 14 Drawing Sheets

(56) References Cited

FOREIGN PATENT DOCUMENTS

| | | | |
|---|---|---|---|
| EP | 2 082 846 | A2 | 7/2009 |
| EP | 2 258 520 | A1 | 12/2010 |

OTHER PUBLICATIONS

International Search Report Corresponding to International Application No. PCT/US2012/030846; Date of Mailing: Oct. 16, 2012; 10 Pages.

Notification Concerning Transmittal of International Preliminary Report on Patentability corresponding to International Application No. PCT/US2012/030846; International Preliminary Report on Patentability; Written Opinion of the International Searching Authority; Date of Mailing: Oct. 10, 2013; 7 Pages.

Notification Concerning Transmittal of International Preliminary Report on Patentability corresponding to International Application No. PCT/US2011/030646; International Preliminary Report on Patentability; Written Opinion of the International Searching Authority; Date of Mailing: Oct. 10, 2013; 7 Pages.

Office Action dated Jan. 12, 2015 from Chinese Patent Application No. CN201280016156 filed Mar. 28, 2012.

* cited by examiner

TWIST LOCK GEAR CASE FOR POWER TOOLS

RELATED APPLICATIONS

This application claims the benefit of and priority to U.S. Provisional Patent Application No. 61/512,183, filed on Jul. 27, 2011, and to PCT Application No. PCT/US2011/030646, filed on Mar. 31, 2011, the contents of which are incorporated herein by reference in their entireties.

FIELD OF THE INVENTION

This invention relates to power tools and is particularly suitable for cordless power tools.

BACKGROUND

Electric power tools, such as drills, nutrunners, and screwdrivers, generally include a housing supporting a motor, a drive train driven by the motor, an output shaft having a first end adapted to engage a fastener and a second end adapted to engage the drive train. Drive trains in these types of power tools need to remain concentric from the motor through the output shaft to avoid gearing misalignment and excessive gear noise.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a power tool includes a motor having an outwardly extending rotor that defines a drive axis, a housing surrounding the motor, and a gearcase that encases a drive train coupled to the rotor and configured to drive a tool output. The gearcase includes a proximal end and an opposite distal end that is exposed to the outside of the tool forward of the housing. The gearcase is rigid enough to support an auxiliary handle in some embodiments of the present invention. A motor mount disposed within the housing includes opposite first and second sides. The motor is secured to the motor mount first side and the gearcase is secured to the motor mount second side such that the drive train is aligned concentrically with the rotor.

The gearcase includes respective locking elements spaced around the periphery of the gearcase proximal end. In some embodiments of the present invention, each locking element extends radially outward from the gearcase and has a tapered configuration. The motor mount includes spaced apart locking elements on the second side thereof that are configured to engage with respective gearcase locking elements. In some embodiments of the present invention, each motor mount locking element includes an arcuate groove that slidably receives a respective gearcase locking element. The proximal end portion of the gearcase is adapted to make contact with the motor mount second side, then rotate such that the gearcase locking elements slidably engage the motor mount locking elements.

According to some embodiments of the present invention, a gearcase for a power tool comprises an elongated housing having opposite, longitudinally spaced apart first and second end portions. The housing is configured to encase a drivetrain of the power tool. The first end portion has an opening configured to receive a rotor from a motor of the power tool that couples with the drive train, and the second end portion has an opening through which an output shaft of the power tool can extend. A plurality of locking elements are spaced peripherally from each other at the first end portion of the housing and are slidably engageable with respective locking elements on a motor mount of the power tool to which the gearcase is secured. In some embodiments of the present invention, the gearcase locking elements extend outward axially from a periphery of the first end portion of the housing. In some embodiments of the present invention, the gearcase locking elements have a tapered configuration that cause an interference fit with respective motor mount locking elements.

In some embodiments of the present invention, the first end portion of the gearcase housing includes a pair of mounting lugs extending outwardly therefrom that are configured to be secured to a housing of the power tool. In some embodiments of the present invention, a flange extends outwardly from and around an outer surface of the gearcase housing and is configured to engage an interior portion of the housing of the power tool.

According to some embodiments of the present invention, a motor mount for a power tool includes a base having opposite first and second sides. The base first side is configured to be attached to a motor of the power tool, and the base second side is configured to be attached to a gearcase that encases a drivetrain of the power tool. An opening extends through the base between the first and second sides and is configured to receive a motor rotor therethrough that couples with the drive train. A plurality of locking elements are located at the base second side that are configured to secure the gearcase to the base. The locking elements are spaced from each other and are engageable with respective gearcase locking elements by rotative motion of the gearcase relative to the motor mount. In some embodiments of the present invention, each motor mount locking element comprises an arcuate groove configured to slidably receive a respective gearcase locking element therein.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate some exemplary embodiments. The drawings and description together serve to fully explain the exemplary embodiments.

DETAILED DESCRIPTION

Figure 1:
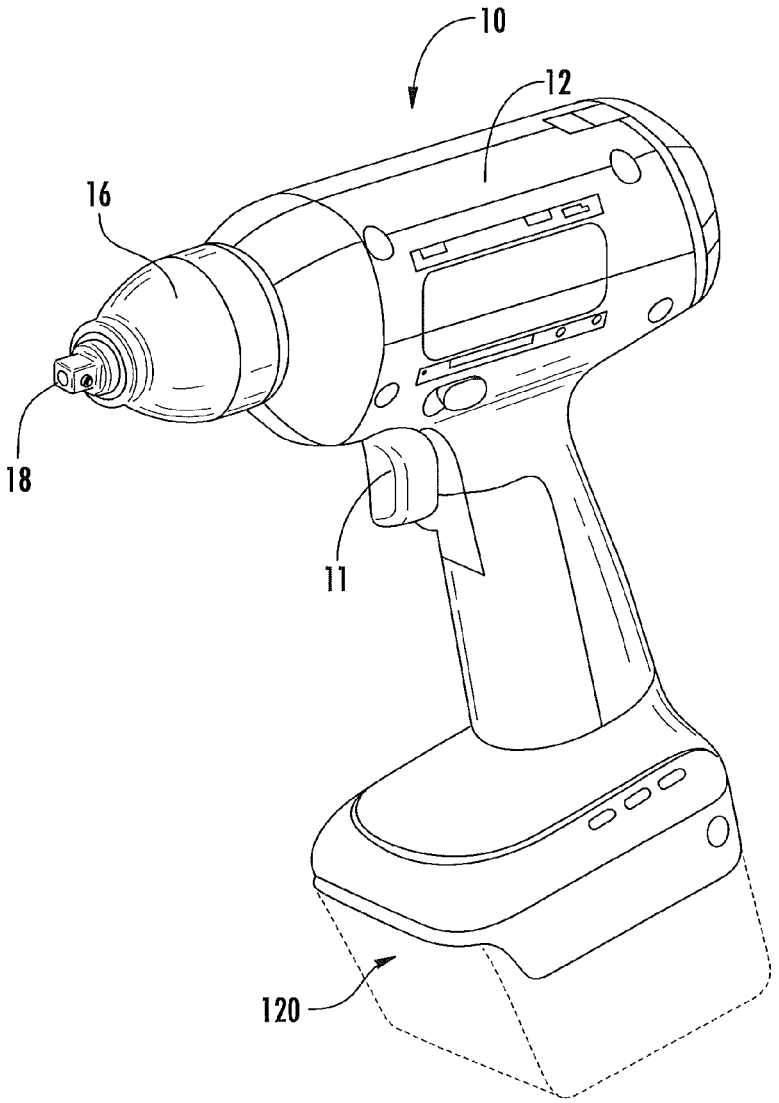
FIG. 1 is a side perspective view of an exemplary cordless power tool, according to some embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment of figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "cordless" power tool refers to a power tool that does not require plug-in, hard wired electrical connections to an external power source to operate. Rather, cordless power tools have electric motors that are powered by on-board batteries, such as rechargeable batteries. A range of batteries may fit a range of cordless power tools. Different cordless power tools may have a variety of electrical current demand profiles that operate more efficiently with batteries providing a suitable range of voltages and current capacities. The different cordless (e.g., battery powered) power tools can include, for example, drills, screwdrivers, ratchets, nutrunners, impacts and the like.

Embodiments of the present invention may be particularly suitable for precision power tools that can be used for applications where more exact control of the applied output is desired.

Figure 2:
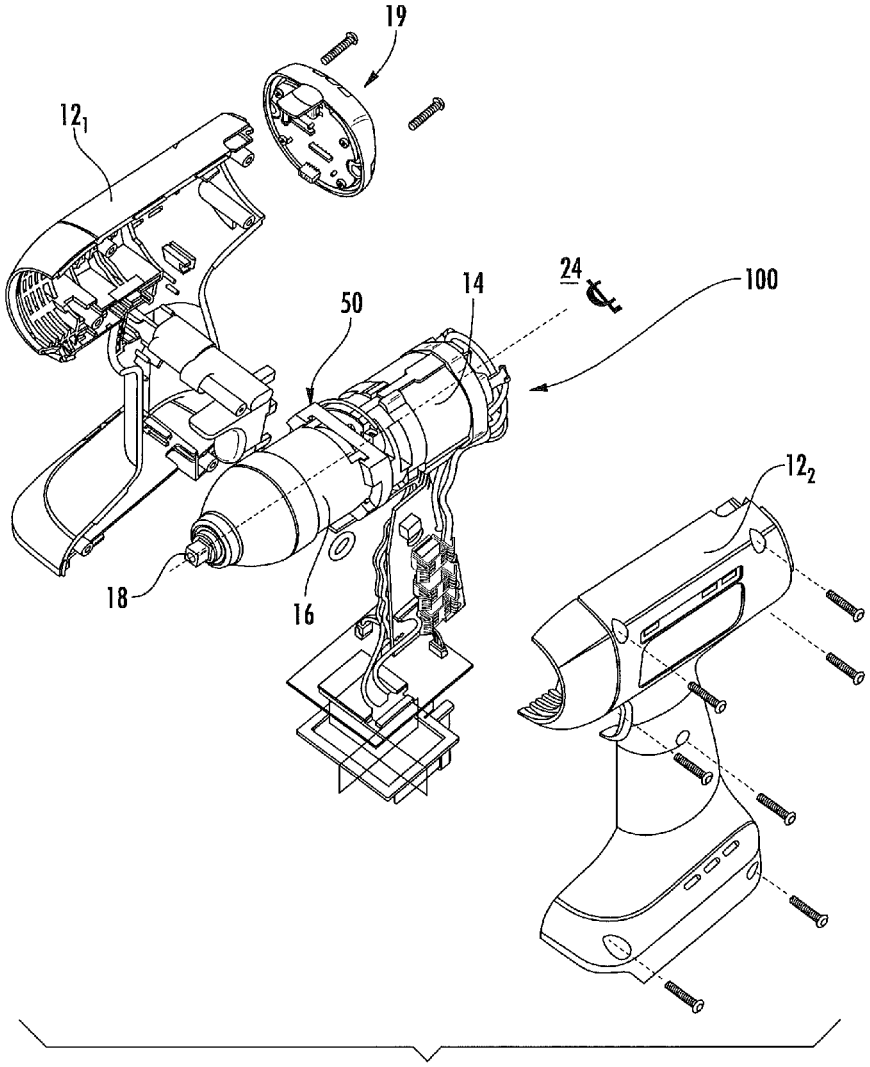
FIG. 2 is an exploded view of the tool shown in FIG. 1.
Figure 3:
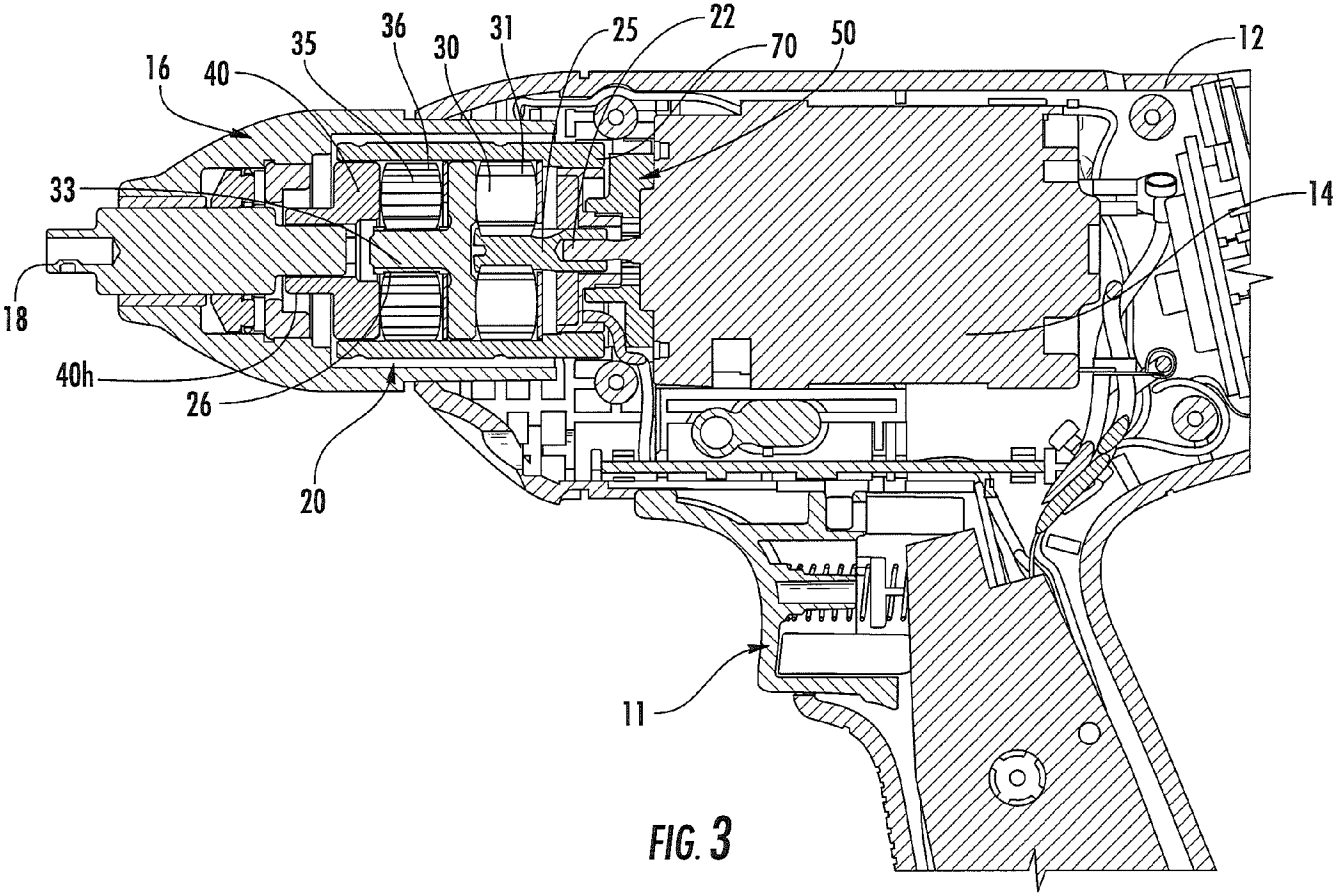
FIG. 3 is a side section view of the power tool shown in FIG. 1, according to some embodiments of the present invention.
Figure 4:
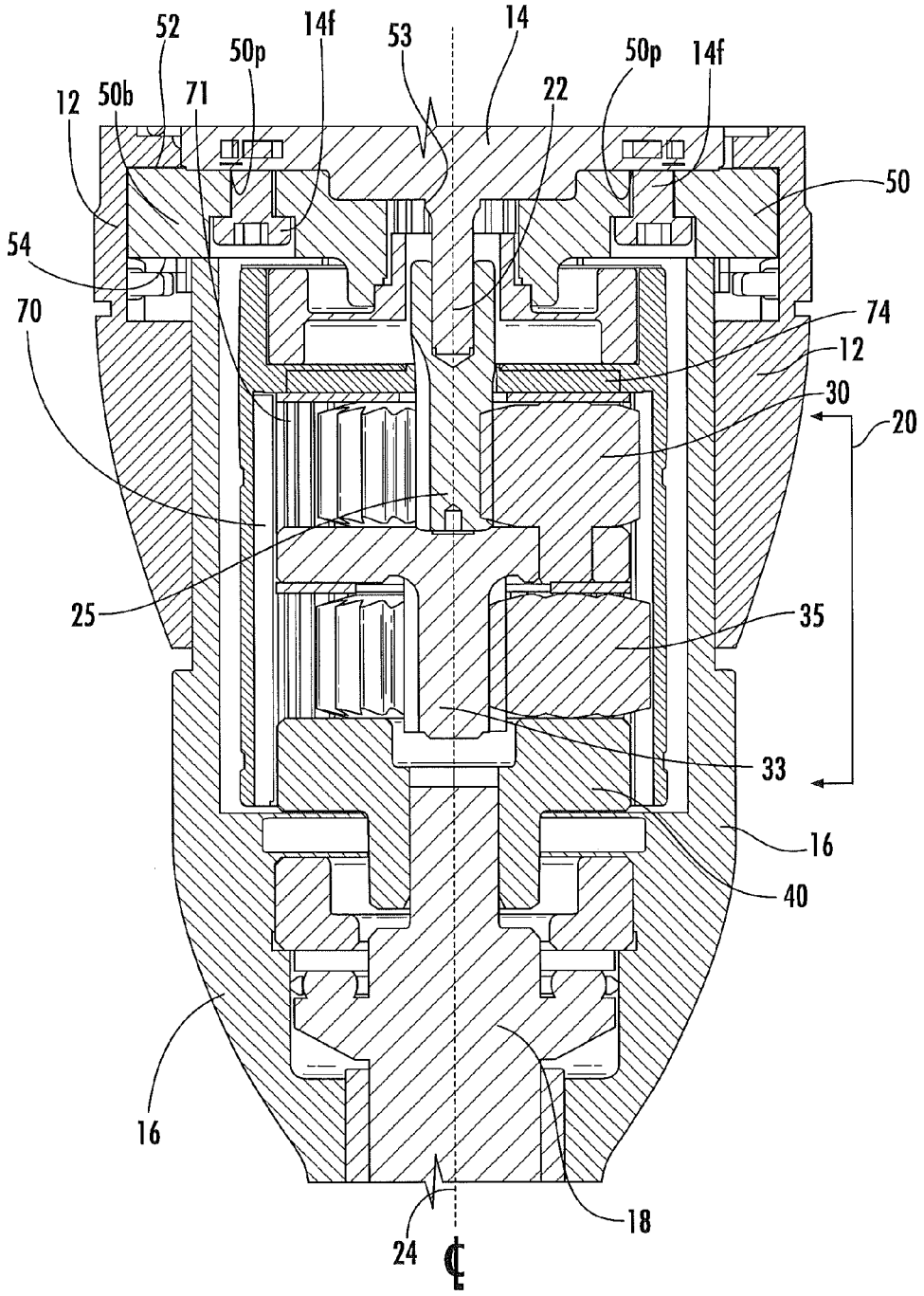
FIG. 4 is a top section view of a portion of the power tool shown in FIG. 1, according to some embodiments of the present invention.
Figure 5:
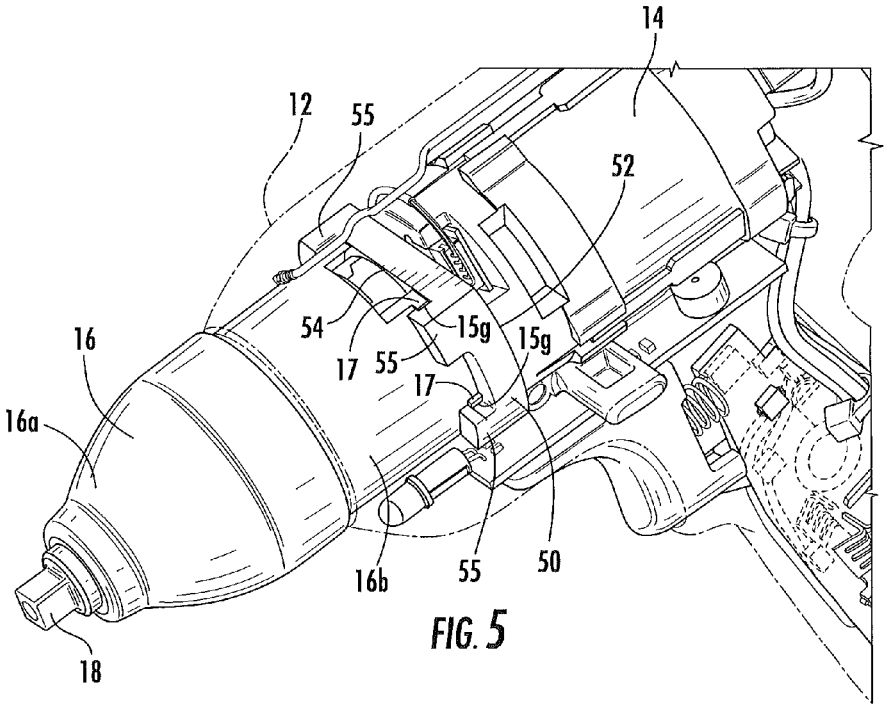
FIG. 5 is a side perspective view of a portion of the tool shown in FIG. 1 with the housing transparent to illustrate the gearcase secured to the motor mount, according to some embodiments of the present invention.
Figure 6:
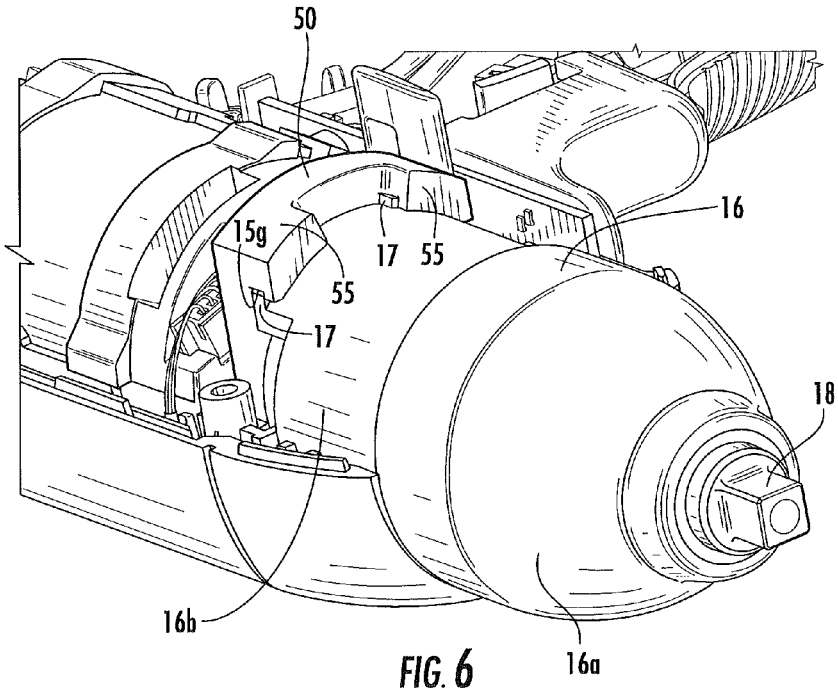
FIG. 6 is a partial front perspective view of the tool shown in FIG. 5, with a part of the housing omitted.
Figure 9A:
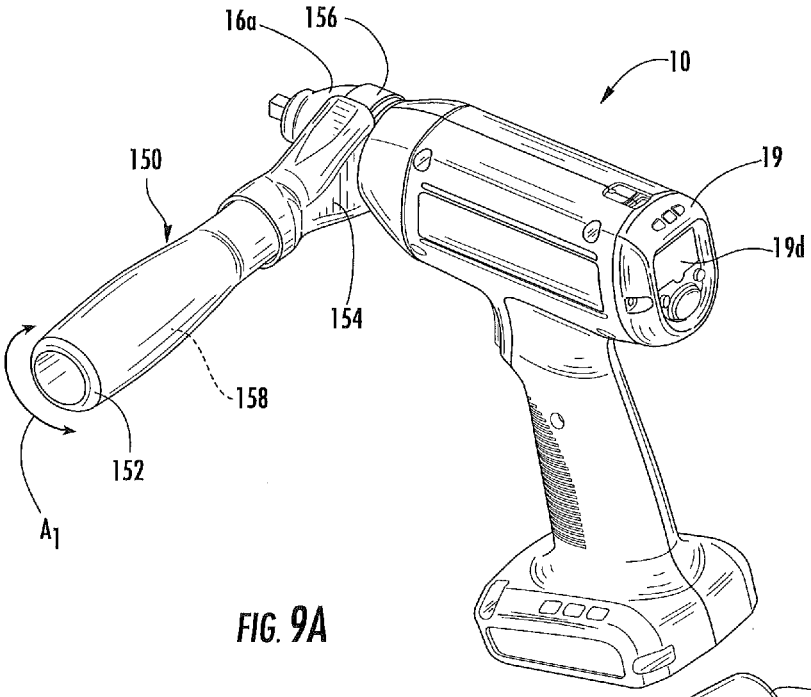
FIG. 9A is a top rear perspective view of the tool of FIG. 1 with an auxiliary handle removably secured to the gearcase, according to some embodiments of the present invention.

FIGS. 1 and 2 illustrate a power tool 10, according to some embodiments of the present invention. The power tool 10 includes a housing 12, a motor 14, a gearcase 16 and a tool output shaft 18. As shown, the housing 12 encases the motor 14 and partially surrounds the gearcase 16. As illustrated in FIGS. 5 and 6, a distal end portion 16*a* of the gearcase 16 has a tapered configuration and is exposed to the outside of the tool forward of the housing 12. The gearcase 16 encloses a drive train 20 (FIGS. 3, 4). The lower portion of the housing 12 can releasably engage a battery 120 (shown in broken line in FIG. 1). The housing 12 can include an external control such as a trigger 11 and a UI (user interface) 19 with a display 19*d* (FIG. 9A).

As shown in FIGS. 2 and 4, the motor 14 can be held in a desired fixed position and orientation in the housing 12 using a motor mount 50. As illustrated in FIG. 4, the motor mount 50 has a base 50*b* with opposite first and second sides 52, 54. The motor 14 is attached to the motor mount first side 52 via fasteners 14*f*, such as screws, bolts, threaded rods, and the like, that extend through respective passageways 50*p* in the motor mount base 50*b* (FIGS. 4, 7A).

Figure 7A:
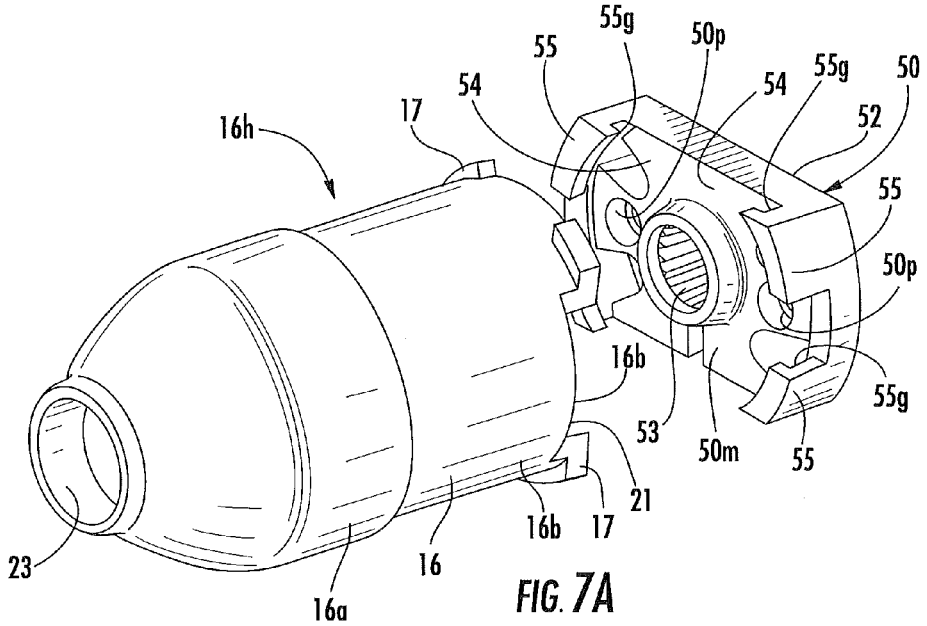
FIG. 7A is an exploded perspective view of the gearcase and motor mount of the tool shown in FIG. 5.
Figure 7B:
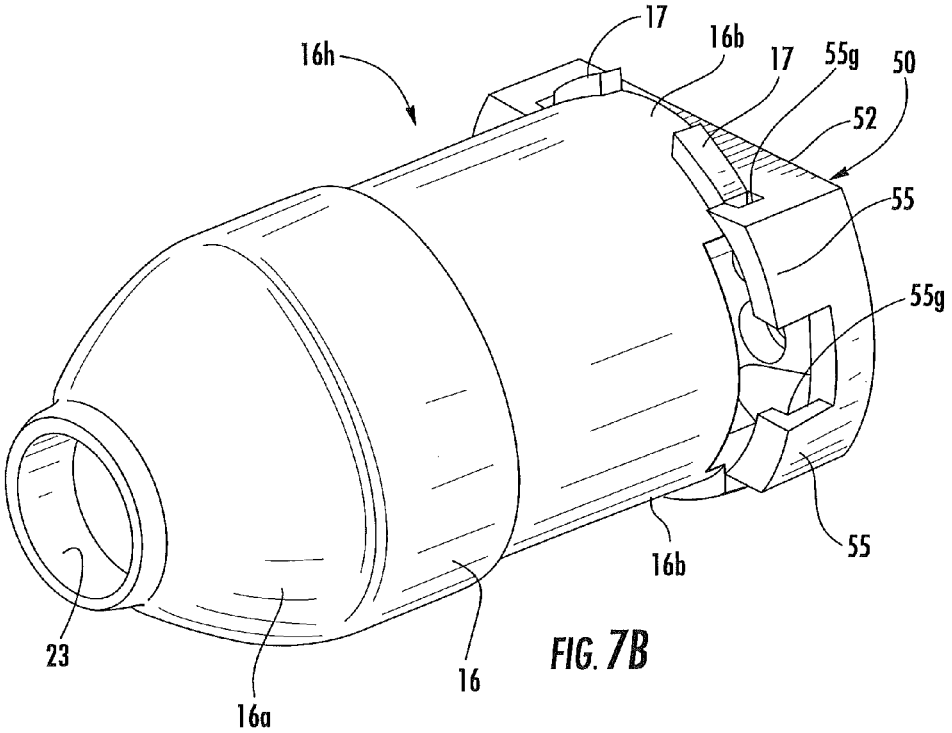
FIG. 7B illustrates the gearcase and motor mount of FIG. 7A in contacting relationship prior to securing the gearcase to the motor mount by rotating the gearcase relative to the motor mount.
Figure 7C:
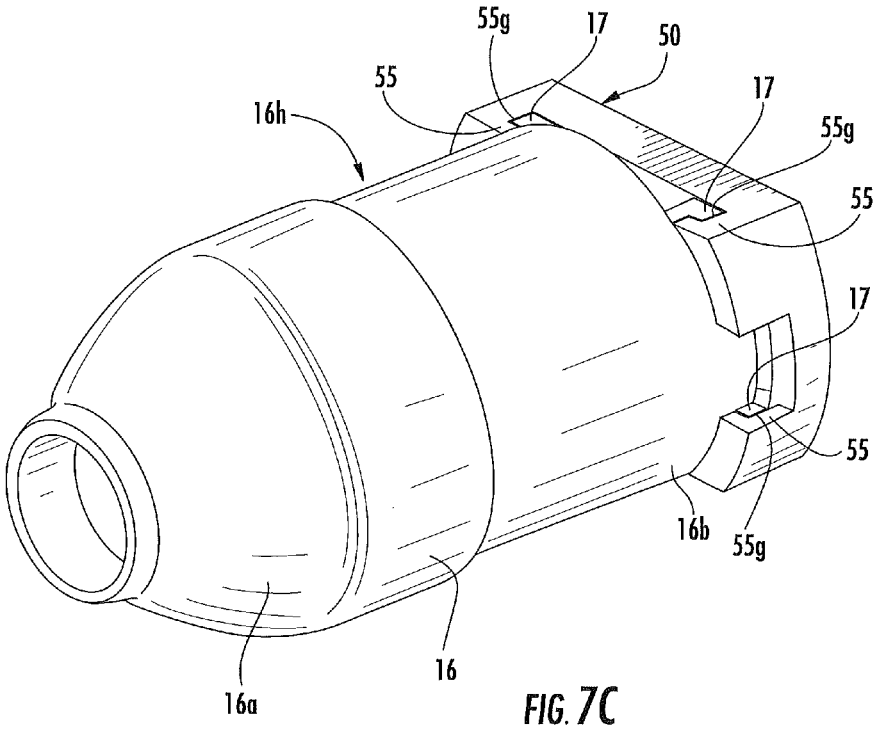
FIG. 7C illustrates the gearcase and motor mount of FIG. 7B after clockwise rotation of the gearcase relative to the motor mount such that the gearcase is secured to the motor mount.

Referring to FIGS. 7A-7C, the gearcase 16 has an elongated housing 16*h* with opposite, longitudinally spaced apart distal and proximal end portions 16*a*, 16*b*. As noted above, the gearcase housing 16*h* is configured to encase a drivetrain of the power tool 10. The proximal end portion 16*b* has an opening 21 configured to receive a rotor 22 (FIG. 3) from the motor 14 of the power tool 10 that couples with the drive train 20 (FIG. 3). The distal end portion 16*a* has an opening 23 through which an output shaft 18 of the power tool 10 extends. The gearcase housing 16*h* is rigidly mounted to the motor mount 50 second side 54 via gearcase locking elements 17 that cooperate with and slidably engage motor mount locking elements 55 creating a single unified drive train. As described below, the gearcase 16 can twist to matably secure to the motor mount 50 second side 54. The gearcase 16 (and encased drive train 20) with the motor mount 50 and motor 14 can define or form part of a motor sub-assembly 100 (FIG. 2) that can be placed into the outer housing 12, which as shown in FIG. 2, may be provided as two matable sections $\mathbf{12}_1$, $\mathbf{12}_2$. In some embodiments, the matable housing sections $\mathbf{12}_1$, $\mathbf{12}_2$ are substantially symmetrical.

Referring to FIGS. 3 and 4, the motor 14 includes a motor rotor 22 (e.g., motor output shaft) that extends through an opening 53 in the motor mount 50 toward the tool output shaft 18 and has a centerline that coincides with a drive train center axis 24. The motor rotor 22 is attached to a pinion gear 25 having a plurality of splines or teeth 26. The motor rotor 22 drives the pinion gear 25 which engages the drive train 20, which thereby drives the tool output shaft 18.

The drive train 20 includes a first stage of planetary gears 30 and a second stage of planetary gears 35 that reside inside a ring gear 70. The ring gear 70 does not itself rotate, but defines an outer wall for the planetary gears 30, 35. The ring gear 70 is cylindrical and includes a wall with an inner surface that includes elongate teeth or splines 71. The teeth 31, 36 of the gears 30, 35 can substantially mate with the ring gear splines or teeth 71 as the planetary gears 30, 35 rotate inside the ring gear 70 during power tool operation.

The drive train 20 first stage of planetary gears 30 is typically three planetary gears and the teeth 31 substantially mate with the teeth 26 of the pinion gear 25. The drive train 20 also includes a gearhead 33 with a gear with splines or teeth and a plate (the plate faces the first stage of gears 30). The first stage of gears 30 drives the gearhead 33. The second stage of planetary gears 35 also typically includes three planetary gears with external teeth 36. The gearhead 33 resides upstream of the first stage of gears 30 and drives the second stage of gears 35. Thus, the first stage (e.g., set) of gears 30 orbit about the pinion gear 25 (see FIGS. 3 and 4) and the second stage (e.g., set) of gears 32 orbit about the output gear of the gearhead 33. In turn, the second stage of gears 35 drive a carrier 40 which drives the tool output shaft 18. A portion of the carrier 40 also resides within the ring gear 70 with a center hub 40*h* that extends a distance outside the ring gear 70 and holds the tool output shaft 18.

Referring now to FIGS. 5-8, the mounting of the gearcase 16 to the motor mount 50 will be described in further detail. In FIG. 5, the housing 12 of the power tool 10 of FIG. 1 is shown as transparent in order to better illustrate the gearcase 16 secured to the motor mount 50 within the tool 10. The illustrated motor mount 50 includes first and second pairs of locking elements 55 in diametrically spaced apart relationship (FIG. 7A). The illustrated motor mount 50 also includes a splined opening 53 extending through a medial portion 50*m* thereof, along with passageways 50*p* extending through the motor mount, one on each side of the splined opening 53. As described above, the motor rotor 22 extends through the opening 53 and couples with the drive train 20 within the gearcase 16. Fasteners 14*f* (FIG. 4) are inserted through the passageways 50*p* to secure the motor 14 to the motor mount first side 52, as described above.

The illustrated locking elements 55 on the motor mount second side 54 are configured to engage with respective gearcase locking elements 17. Each motor mount locking element 55 includes an arcuate groove 55*g* that slidably receives a respective gearcase locking element 17. The proximal end portion 16*b* of the gearcase 16 is adapted to contact the motor mount second side 54 between the respective first and second pairs of locking elements 55 then slidably rotate such that the gearcase locking elements 17 rotatably and securely engage the motor mount locking elements 55.

Figure 8:
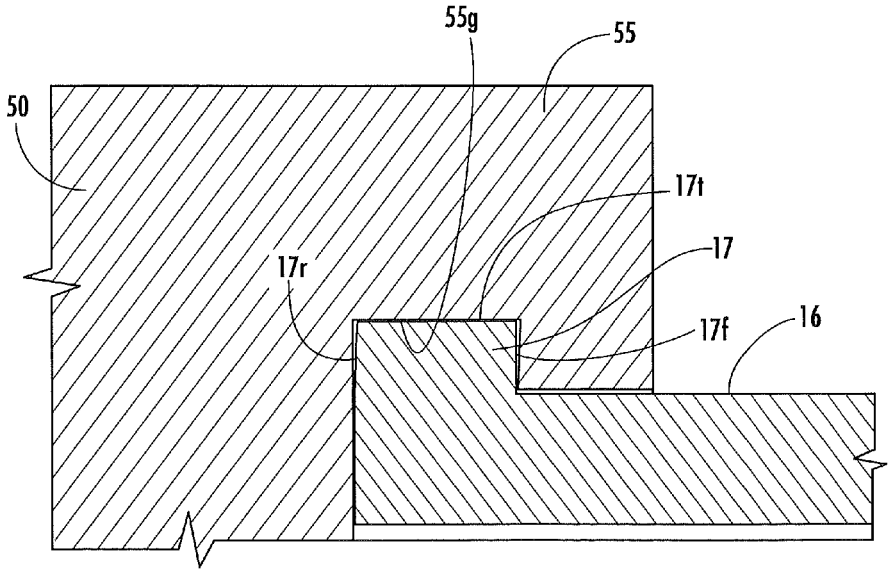
FIG. 8 is an enlarged cross-sectional view of one of the gearcase locking elements engaged with a respective motor mount locking element, according to some embodiments of the present invention.

The gearcase 16 includes respective locking elements 17 spaced around the periphery of the gearcase proximal end 16*b*. Each locking element 17 extends radially outward from the outer surface of the gearcase housing 16*h* and can have a tapered end configuration (FIG. 8). As illustrated in FIG. 8, each locking element 17 includes a top wall 17*t*, a front wall 17*f* and an opposite rear wall 17*r*. One or both of the front and rear walls 17*f*, 17*r* may be tapered. Each gearcase locking element 17 is configured to matably engage a respective one of the arcuate grooves 55*g* in the motor mount locking elements 55. The tapered configuration of each locking element 17 is such that a portion of the locking element 17 is slightly wider than the groove 55*g*. This tapered configuration causes an interference fit between a gearcase locking element 17 and a respective motor mount locking element 55 as a gearcase locking element is rotated within a respective motor mount locking element groove 55*g*. As a result of this interference fit between gearcase locking elements 17 and respective motor mount locking elements 55, the gearcase 16 is snugly secured to the motor mount 50. In addition, the gearcase locking elements 17 and motor mount locking elements 55 are configured to ensure that the drive train 20 within the gearcase 16 is aligned concentrically with the rotor 22 when the gearcase 16 is secured to the motor mount 55.

The gearcase 16 can be a single unitary and/or monolithic body of aluminum, for example, and can be manufactured by metal injection molding. Of course, machining or other processes with sufficient precision may also be used. The motor mount 50 can be a single unitary and/or monolithic body of steel, for example. Machining or other processes with sufficient precision may also be used. Other materials with sufficient rigidity may be used for each of these components and other processes may be used to form the desired shapes and features.

FIG. 7A illustrates the gearcase 16 and motor mount 50 prior to attachment to each other. In FIG. 7B, the gearcase 16 and motor mount 50 are aligned such that the gearcase proximal end 16*b* is in contacting relationship with the motor mount second side 54 and such that each gearcase locking element 17 is positioned to be rotated into a groove 55*g* of a respective motor mount locking element 55. In FIG. 7C, the gearcase 16 has been rotated approximately ninety degrees (90°) clockwise such that each gearcase locking element 17 is slidably received within a respective groove 55*g* of each respective motor mount locking element 55.

Embodiments of the present invention are not limited to the illustrated configuration of the gearcase locking elements 17, motor mount locking elements 55, and grooves 55*g*. Various ways of slidably locking the gearcase 16 to the motor mount 50 may be utilized without limitation. Locking elements 17, 55 with various shapes and configurations may be utilized without limitation. Moreover, different numbers of locking elements 17, 55 may be utilized. Also, in some embodiments of the present invention, the motor mount locking elements 55 and grooves 55*g* can be on the gearcase housing and the locking elements 17 can be on the motor mount 50.

Figure 9B:
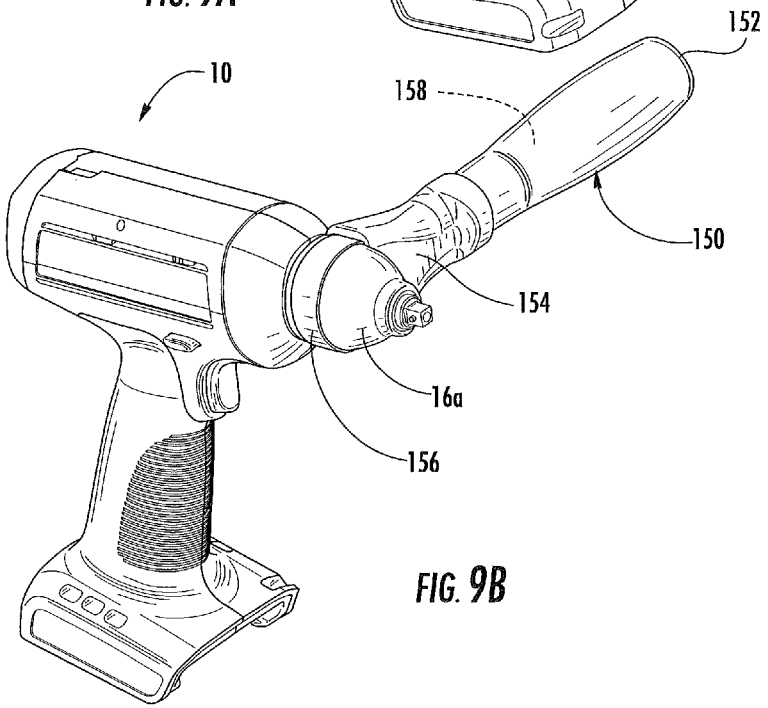
FIG. 9B is a top front perspective view of the tool of FIG. 9A.
Figure 10:
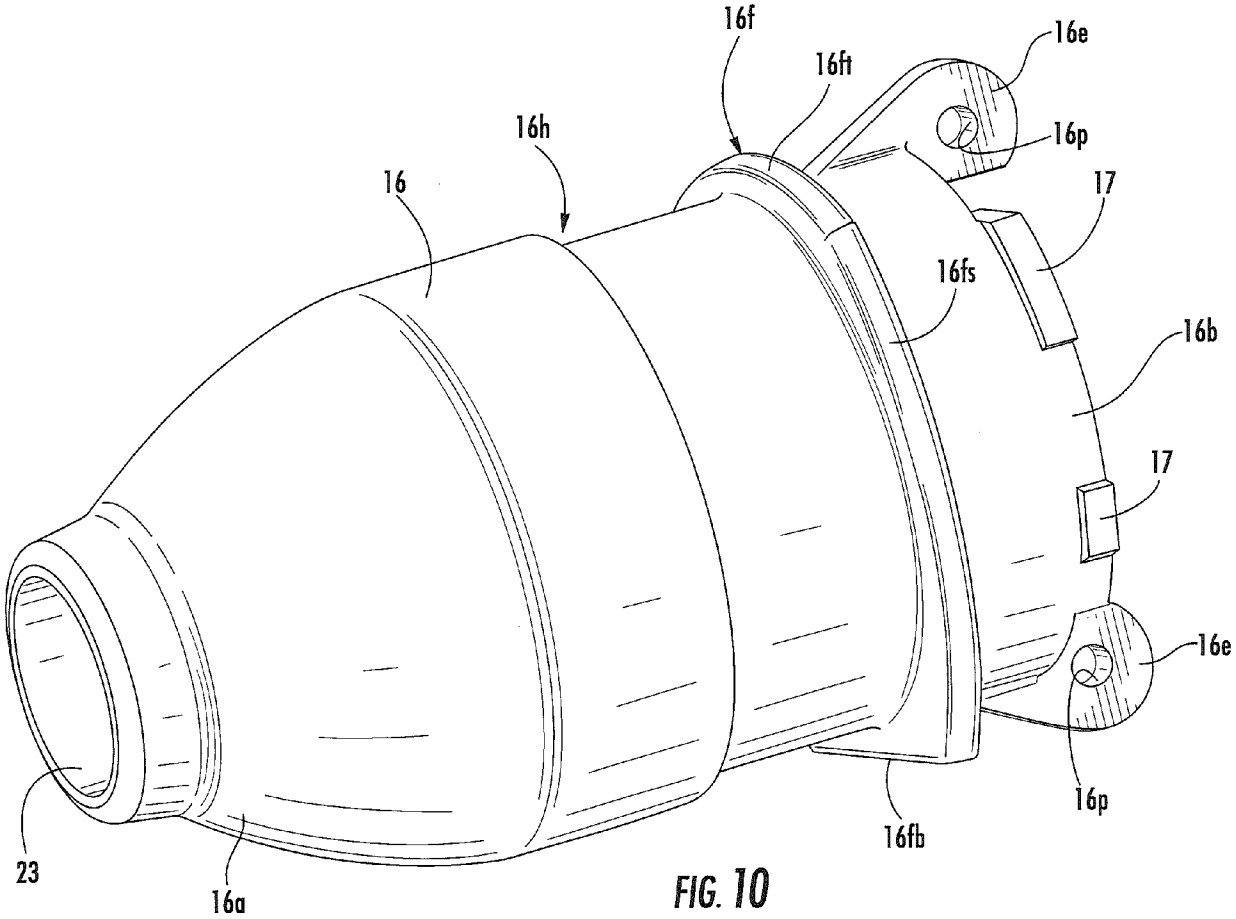
FIG. 10 is a front perspective view of a gearcase for use with a cordless power tool, such as the tool of FIG. 1, according to some embodiments of the present invention.
Figure 11:
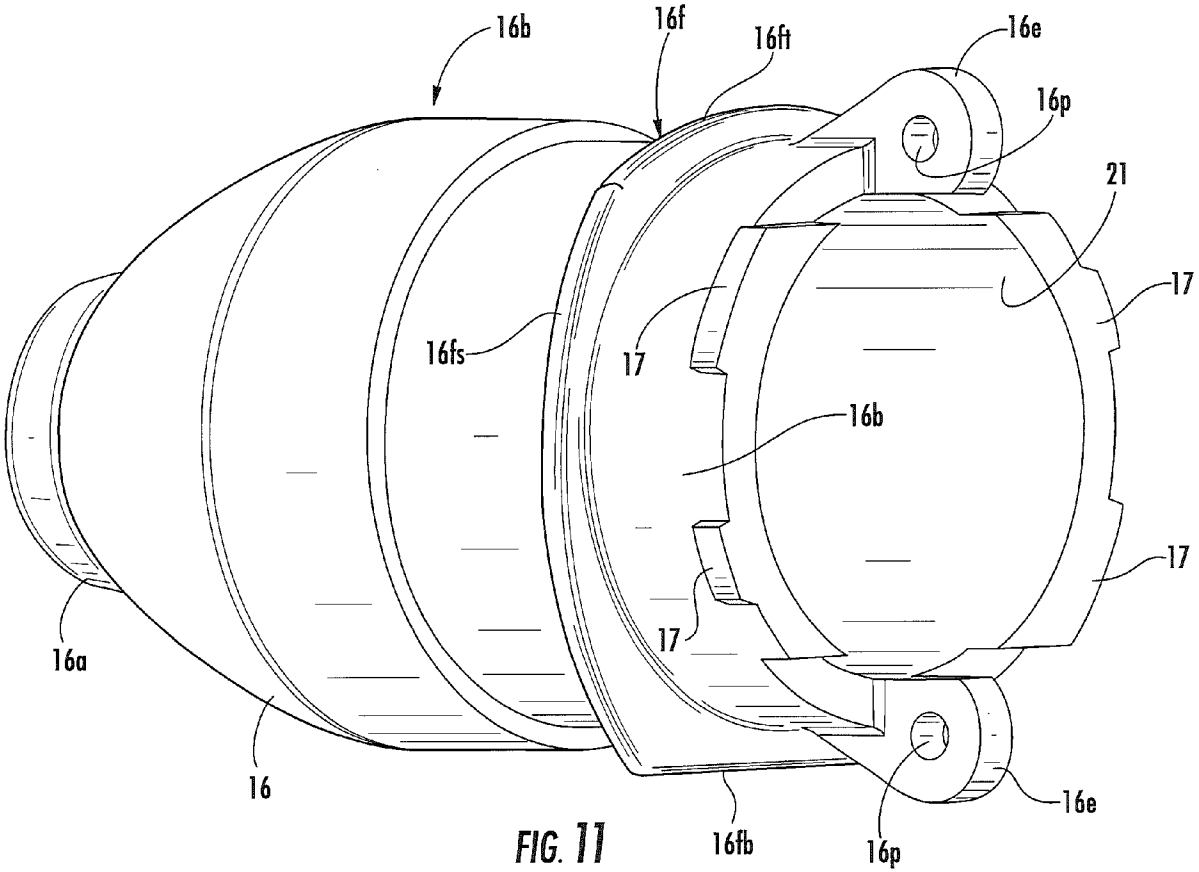
FIG. 11 is a rear perspective view of the gearcase of FIG. 10.
Figures 12A, 12B, 12C:
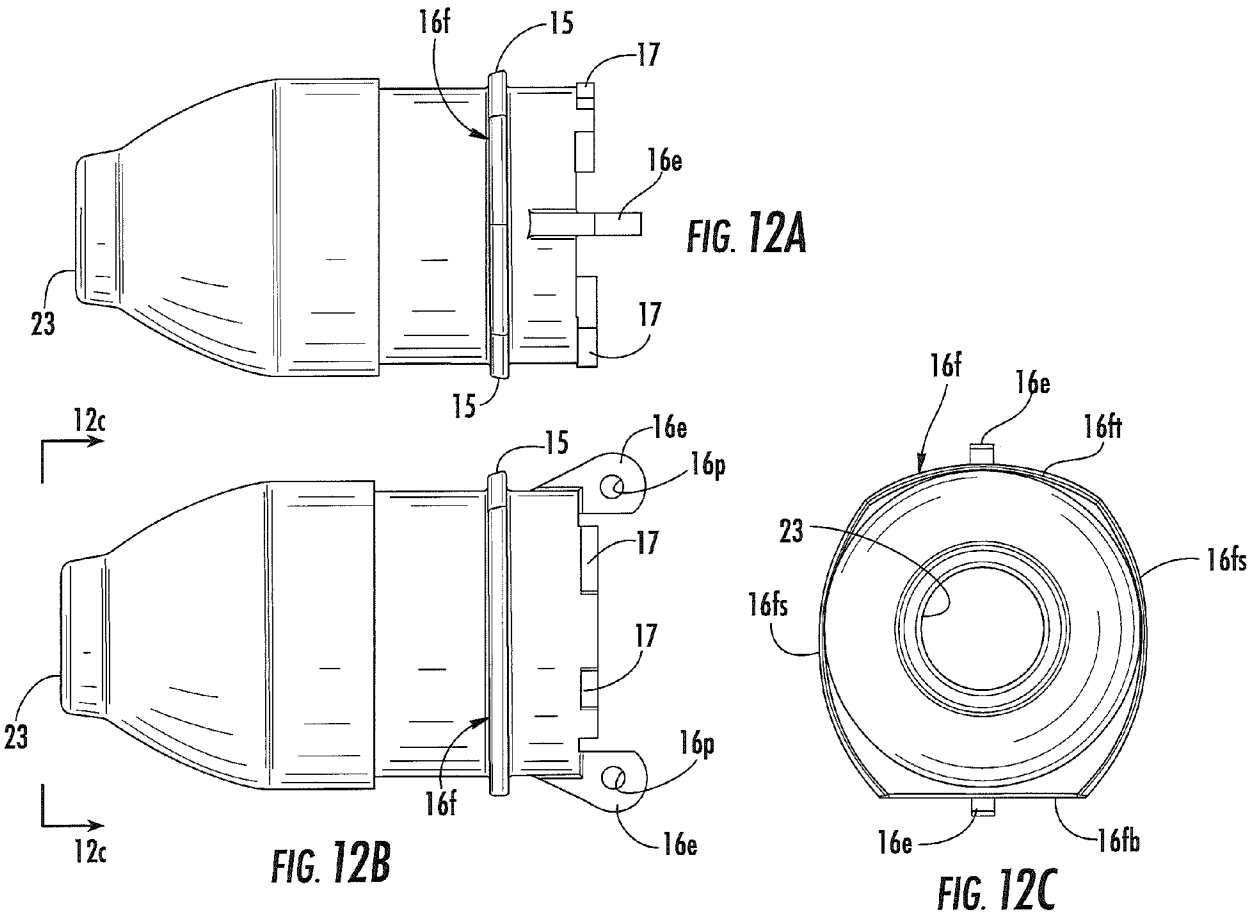
FIG. 12A is a side view of the gearcase of FIG. 10.
FIG. 12B is a side view of the gearcase of FIG. 10 rotated ninety degrees.
FIG. 12C is a front end view of the gearcase of FIG. 12B taken along lines 12C-12C.

Referring to FIGS. 9A-9B, an auxiliary handle 150 configured to be gripped by a user of the tool 10 may be removably secured to the exposed portion (i.e., the distal end 16*a*) of the gearcase 16. The gearcase 16 provides a rigid support for the auxiliary handle 150. The illustrated handle 150 includes opposite distal and proximal ends 152, 154. An expandable/contractible band 156 extends from the handle proximal end 154 and is configured to surround and grip the gearcase 16 to secure the handle 150 thereto. The handle 150 may include a tightening mechanism 158 therewithin that allows a user to tighten the band 156 around the gearcase 16 when attaching the handle 150 to the tool 10 and to loosen the band 156 such that the handle 150 can be removed from the tool 10. In some embodiments of the present invention, the tightening mechanism 158 is operated by axial rotation (illustrated by arrow $A_1$) of the distal end portion of the handle 150. However, other mechanisms that can expand and contract the band 156 may be utilized in accordance with embodiments of the present invention.

Referring to FIGS. 10-15, a gearcase 16 according to other embodiments of the present invention and for use with a cordless power tool, such as the tool 10 of FIG. 1, is illustrated. The gearcase 16 is similar in configuration and function to the gearcase 16 of FIGS. 1-8. The illustrated gearcase 16 of FIGS. 10-15 has an elongated housing 16*h* with opposite, longitudinally spaced apart distal and proximal end portions 16*a*, 16*b*, respectively. The gearcase housing 16*h* is configured to encase a drivetrain of the power tool 10, as described above. The proximal end portion 16*b* has an opening 21 configured to receive a rotor 22 (FIG. 3) from the motor 14 of the power tool 10 that couples with the drive train 20. The distal end portion 16*a* has an opening 23 through which an output shaft 18 (FIG. 1) of the power tool 10 extends.

The gearcase 16 of FIGS. 10-15 includes respective locking elements 17 spaced around the periphery of the gearcase proximal end 16*b*. Each locking element 17 extends radially outward from the outer surface of the gearcase housing 16*h* and has a tapered configuration as described above with respect to the gearcase 16 of FIGS. 1-8. The gearcase housing 16*h* is configured to be rigidly mounted to the second side 54 of the motor mount 50 (FIG. 5) via gearcase locking elements 17 that cooperate with and slidably engage motor mount locking elements 55, as described above.

Figure 13:
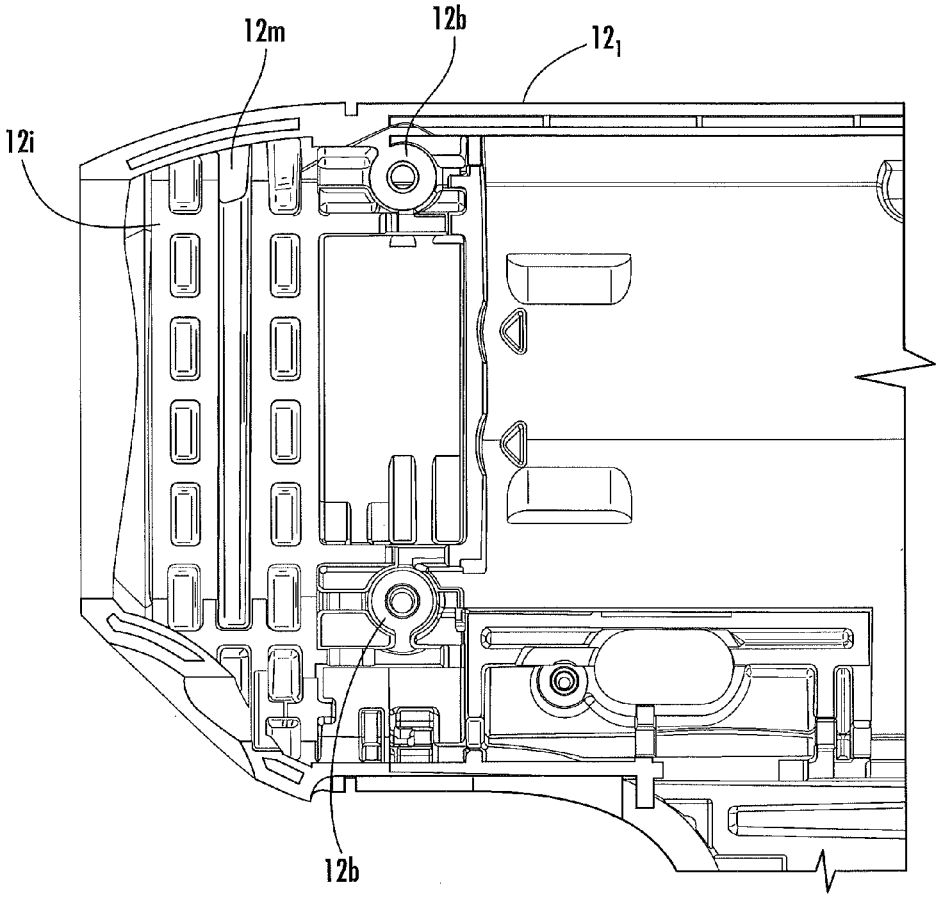
FIG. 13 is an enlarged, partial side view of a housing section of the power tool of FIG. 1 and that illustrates a portion of the housing in which the gearcase flange of FIG. 10 matably engages, according to some embodiments of the present invention.
Figure 14:
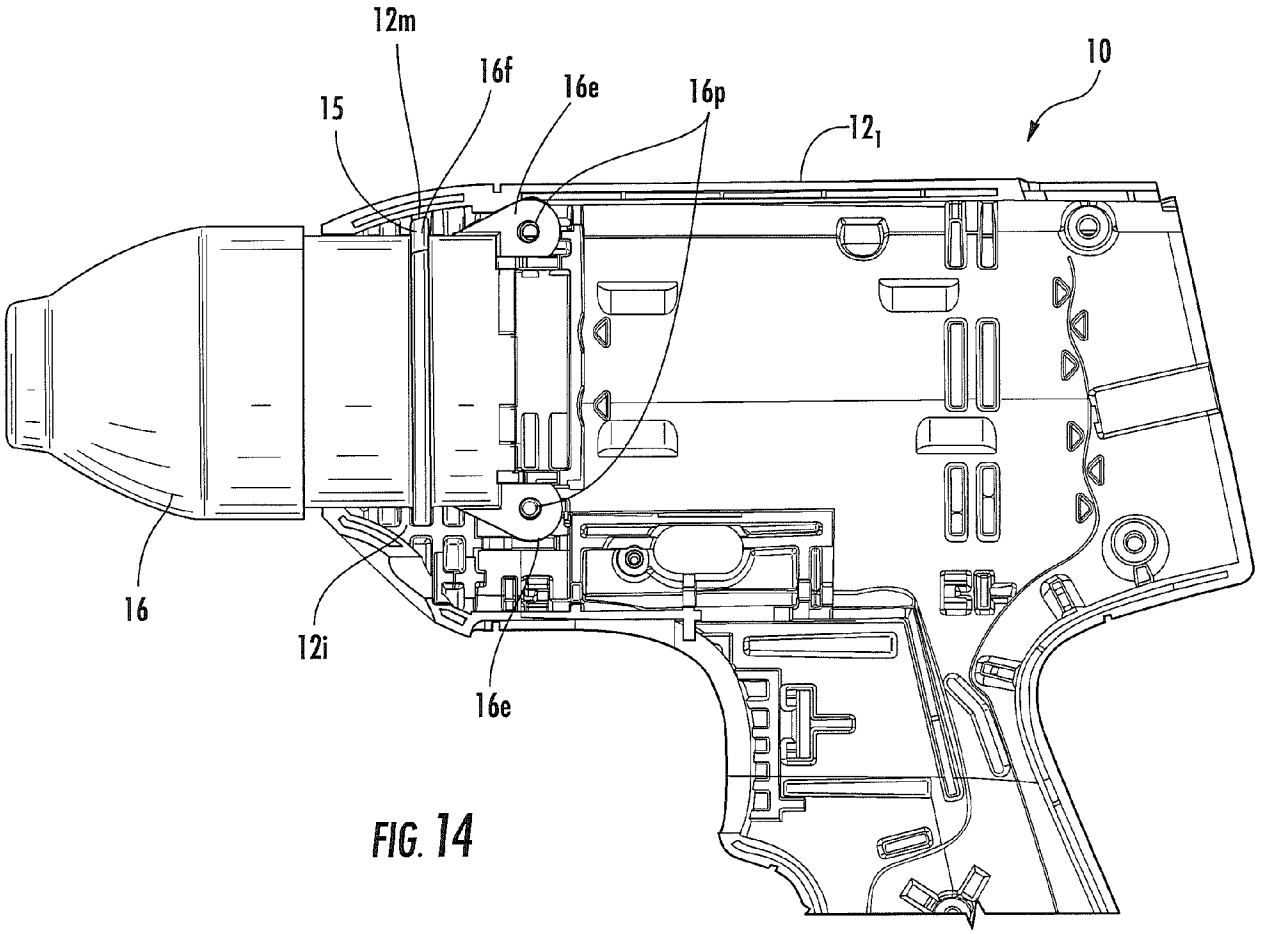
FIG. 14 is a side view of the gearcase of FIG. 10 positioned within a housing section of the power tool of FIG. 1, according to some embodiments of the present invention.
Figure 15:
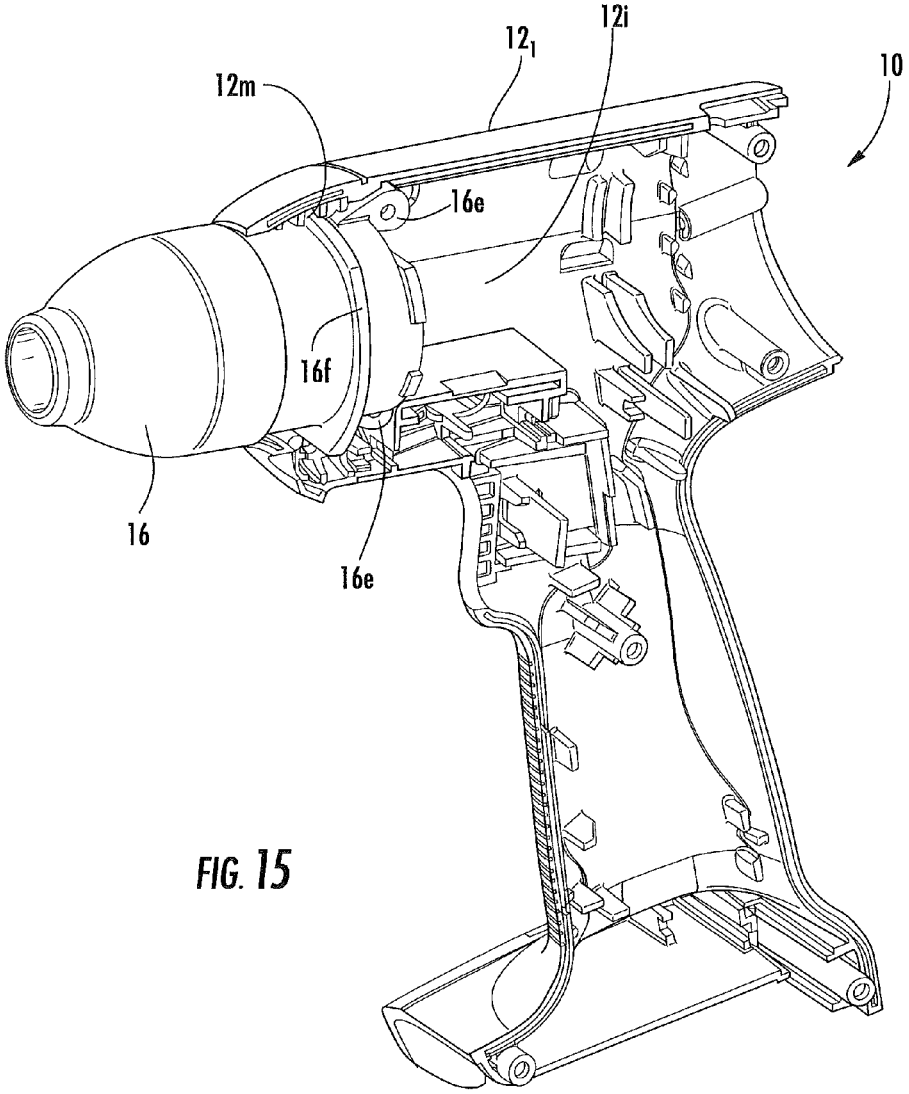
FIG. 15 is a front perspective view of the gearcase of FIG. 10 positioned within a housing section of the power tool of FIG. 1, according to some embodiments of the present invention.

The gearcase 16 of FIGS. 10-15 includes a flange 16*f* that extends around the outer surface of the gearcase housing 16*h* adjacent to the proximal end portion 16*b*, as illustrated. The flange 16*f* can have an arcuate top portion 16*ft*, arcuate side portions 16*fs* and a generally flat bottom portion 16*fb*. The illustrated flange 16*f* also includes a tapered outer surface 15. The configuration of flange 16*f* and the tapered contour of the flange outer surface 15 are designed to mate with one or more portions 12*m* of the interior 12*i* of the housing 12 of the tool 10 (FIGS. 13-15). The flange 16*f* helps lock the gearcase 16 to the housing and helps prevent the gearcase 16 from moving. Moreover, the mating arrangement of the flange 16*f* and housing portion(s) 12*m* provides strength and rigidity to an assembled tool 10. The flange 16*f* may have various shapes and configurations selected for locking engagement with a housing of a power tool. Embodiments of the present invention are not limited to the illustrated configuration or location of the flange 16*f* and corresponding internal features of the housing 12.

The gearcase 16 of FIGS. 10-15 also includes a plurality, typically a pair, of mounting lugs or "ears" 16*e* arranged in diametrically opposed relationship at the proximal end portion 16*b*, as illustrated. Each ear 16*e* includes an aperture 16*p* formed therethrough. Each ear 16*e* is configured to align with a respective threaded boss 12*b* (FIGS. 2, 3, 13) in housing section $\mathbf{12}_1$ and with a respective aperture 12*c* in housing section $\mathbf{12}_2$ (FIG. 2) when the gearcase 16 is assembled within the housing 12. FIGS. 14 and 15 illustrate the gearcase 16 positioned within the housing section $\mathbf{12}_1$ such that each gearcase ear 16*e* abuts a respective threaded boss 12*b*. Housing assembly screws 13 (FIG. 2) extend through the apertures 12*c* in housing section $\mathbf{12}_2$, through the apertures 16*p* in the gearcase ears 16*e*, and threadingly engage with the threaded bosses 12*b* in housing section $\mathbf{12}_1$. The gearcase ears 16*e* provide a rigid, structurally buttressing connection between the gearcase 16 and the housing 12, thereby enhancing strength and rigidity of the tool housing 12. Moreover, the gearcase ears 16*e* help lock the gearcase 16 in the housing 12 and help prevent the gearcase 16 from moving when the tool 10 is assembled.

The gearcase 16 of FIGS. 10-15, including flange 16*f* and ears 16*e*, can be a single unitary and/or monolithic body of aluminum or other relatively light but structurally strong material. The body can be manufactured by metal injection molding. Of course, machining, forging, casting or other material forming processes with sufficient precision may also be used.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A power tool, comprising:

a motor having an outwardly extending rotor that defines a drive axis;

a housing surrounding the motor; and a gearcase encasing a drive train coupled to the rotor and configured to drive a tool output, wherein the gearcase has opposing, longitudinally spaced apart first and second end portions, the first end portion encased by the housing and the second end portion exposed to the outside of the tool forward the housing, wherein the gearcase first end portion comprises a pair of mounting lugs extending outwardly therefrom that are secured to an interior of the housing.

2. The power tool of claim 1, further comprising a motor mount having opposite first and second sides, wherein the motor is secured to the motor mount first side, wherein the gearcase is secured to the motor mount second side, and wherein the rotor extends through the motor mount to couple with the drive train.

3. The power tool of claim 2, wherein the gearcase is secured to the motor mount second side such that the drive train is aligned concentrically with the rotor.

4. The power tool of claim 2, further comprising interengageable locking elements on the gearcase and motor mount second side that hold the gearcase securely to the motor mount.

5. The power tool of claim 4, wherein the gearcase locking elements are spaced peripherally from each other at the first end portion of the gearcase and are engageable with the motor mount locking elements by rotative motion of the gearcase relative to the motor mount.

6. The power tool of claim 4, wherein each gearcase locking element extends outward axially from a periphery of a rear end of the gearcase, and wherein each motor mount locking element comprises an arcuate groove configured to slidably receive a respective gearcase locking element therein.

7. The power tool of claim 6, wherein the gearcase locking elements have a tapered configuration sized to cause an interference fit with the motor mount locking elements.

8. The power tool of claim 1, further comprising an auxiliary handle removably secured to the gearcase that is configured to be gripped by a user of the tool.

9. The power tool of claim 8, wherein the auxiliary handle is secured to the gearcase via a band surrounding the gearcase, and wherein the handle comprises a tightening mechanism connected to the band for tightening and loosening the band relative to the gearcase.

10. The power tool of claim 1, wherein the housing comprises two substantially symmetrical sections releasably engaged.

11. The power tool of claim 1, wherein the gearcase comprises an outwardly projecting circumferentially extending flange that engages an interior portion of the housing.

12. The power tool of claim 1, wherein the power tool is a cordless power tool.

13. A gearcase for a power tool, the gearcase comprising:

an elongated housing having opposite, longitudinally spaced apart first and second end portions, wherein the housing is configured to encase a drivetrain of the power tool, wherein the first end portion has an opening configured to receive a rotor from a motor of the power tool that couples with the drive train, and wherein the second end portion has an opening through which an output shaft of the power tool can extend; and a plurality of locking elements at the housing first end portion configured to secure the housing to a motor mount of the power tool, wherein the first end portion of the housing comprises a pair of mounting lugs extending outwardly therefrom that are configured to be secured to an interior portion of a housing of the power tool.

14. The gearcase of claim 13, wherein the locking elements are spaced peripherally from each other at the first end portion of the housing and are rotatably engageable with respective locking elements on the motor mount.

15. The gearcase of claim 13, wherein the locking elements extend outward axially from a periphery of the first end portion of the housing.

16. The gearcase of claim 13, wherein the locking elements have a tapered configuration that cause an interference fit with respective motor mount locking elements.

17. The gearcase of claim 13, wherein the gearcase housing comprises an outwardly extending flange configured to engage an interior portion of a housing of the power tool.

18. A motor mount for a power tool, the motor mount, comprising:

a base having opposite first and second sides, wherein the first side is configured to be attached to a motor of the power tool, and wherein the second side is configured to be attached to a gearcase that encases a drivetrain of the power tool, wherein an opening extends through the base between the first and second sides and is configured to receive a motor rotor therethrough that couples with the drive train; and a plurality of locking elements at the base second side configured to secure the gearcase to the base, wherein the opening is a splined opening.

19. The motor mount of claim 18, wherein the locking elements are spaced from each other and are engageable with respective gearcase locking elements by rotative motion of the gearcase relative to the motor mount.

20. The motor mount of claim 18, wherein each motor mount locking element comprises an arcuate groove configured to slidably receive a respective gearcase locking element therein.

* * * * *